US010699679B1

(12) United States Patent
Kamimoto

(10) Patent No.: US 10,699,679 B1
(45) Date of Patent: Jun. 30, 2020

(54) DEAD SPOT ELIMINATION APPARATUS FOR A STRINGED INSTRUMENT

(71) Applicant: Hideo Kamimoto, Campbell, CA (US)

(72) Inventor: Hideo Kamimoto, Campbell, CA (US)

( * ) Notice: Subject to any disclaimer, the term of this patent is extended or adjusted under 35 U.S.C. 154(b) by 0 days.

(21) Appl. No.: 16/562,259

(22) Filed: Sep. 5, 2019

(51) Int. Cl.
*G10D 3/02* (2006.01)

(52) U.S. Cl.
CPC ..... *G10D 3/02* (2013.01)

(58) Field of Classification Search
CPC ..... G10D 3/02
See application file for complete search history.

(56) References Cited

U.S. PATENT DOCUMENTS 8,592,668 B1 * 11/2013 Kamimoto ..... G10D 3/00 84/294
8,735,702 B1 * 5/2014 Miles ..... A61F 2/013 84/327
2009/0188370 A1 * 7/2009 DeJule ..... G10D 3/046 84/294

* cited by examiner

*Primary Examiner* — Kimberly R Lockett
(74) *Attorney, Agent, or Firm* — Theodore J. Bielen, Jr.

(57) ABSTRACT

A dead spot elimination apparatus for a stringed instrument utilizing a resonator having an adjustable frequency response via an elongated member. A weight body is mounted to the elongated member and an adjustable frequency damper is formed at the weight body.

12 Claims, 2 Drawing Sheets

DEAD SPOT ELIMINATION APPARATUS FOR A STRINGED INSTRUMENT

BACKGROUND OF THE INVENTION

The present application relates to a novel and useful dead spot elimination apparatus for employment on a stringed instrument.

The long decay of a string vibration on a stringed instrument, such as an electric guitar, is considered to be a quality attribute. In reality, a phenomenon known as the "dead spot" exists and reveals itself as a lack of "sustain" on a note, usually in the range of C, C#, or D when played on the G string, in the case of an electric bass. In other words, the sound at a dead spot dies away quickly and does not possess "sustain", being shorter than the notes played at adjacent frets on either side of the affected note. Although the entire bass vibrates when a bass electric guitar is played at the dead spot, resonance in the neck of the bass causes the problem. In other words, at a dead spot the energy generated by a particular string flows to the neck, which results in a faster decay of the note.

In the past, a novel device found in U.S. Pat. No. 8,592,668 successfully eliminates wolf notes in stringed instruments such as cellos, violins, and the like. However, such device has limited success in eliminating dead spots on stringed instruments such as electric basses.

A dead spot elimination apparatus for employment on a stringed instrument, which is easily installed and operated, would be a notable advance in the musical instrument field.

SUMMARY OF THE INVENTION

In accordance with the present application, a novel and useful dead spot elimination apparatus is herein provided.

The apparatus includes a resonator which utilizes a base and an extending, elongated member. The resonator further includes a guide for adjusting the relative position of the elongated member relative to the base. A weight body is mounted on the elongated member and positioned apart from the base in this respect. Thus, the distance of the elongated member and connected weight from the base may be readily adjusted. A foot may be connected to the base and is adapted to lie atop a portion of the stringed instrument and is capable of being fastened thereto.

The apparatus of the present application also is constructed with a sonic damper. The sonic damper is constructed in the form of an elastomeric element that fits into a recess or aperture formed in the weight body connected to the elongated member. Elastomeric element at least partially occupies the recess of the weight body and contacts the elongated member of the weight body. In addition, the sonic damper includes a tensioner which take the form of a pressing shaft. The tensioner is able to contact the elastomeric element and impose varying forces thereupon. The shaft of the tensioner may be fashioned to extend through the weight body and to include a hand-operated knob. In addition, the sonic damper may include a plurality of resilient elements positioned adjacent the elastomeric member to supplement the damping function of the elastomeric member. Moreover, the plurality of resilient elements may each circumvent the elongated member extended into the weight body and may contact the elastomeric member within the recess of the weight body.

It may be apparent that a novel and useful sonic dead spot elimination apparatus has been hereinabove described.

It is therefore an object of the present application to provide a sonic dead spot elimination apparatus that may be attached to a stringed instrument without modifying the instrument.

Another object of the present application is to provide a sonic dead spot elimination apparatus that is tunable to a desired resonant frequency inherent in a stringed instrument producing the dead spot while generating a particular note.

Another object of the present application is to provide a sonic dead spot elimination apparatus which includes a damping mechanism that is adjustable to broaden the frequency response of the apparatus.

Another object of the present application is to provide a sonic dead spot elimination apparatus which is easily installed on a stringed instrument and is simple to employ.

The application possesses other objects and advantages especially as concerns particular characteristics and features thereof which will become apparent as the specification continues.

For a better understanding of the application, reference is made to the following detailed description of the preferred embodiments thereof which should be referenced to the prior described drawings.

DETAILED DESCRIPTION OF THE PREFERRED EMBODIMENTS

Various aspects of the present application will evolve from the following detailed description of the preferred embodiments thereof which should be referenced to the prior delineated drawings.

Figure 1:
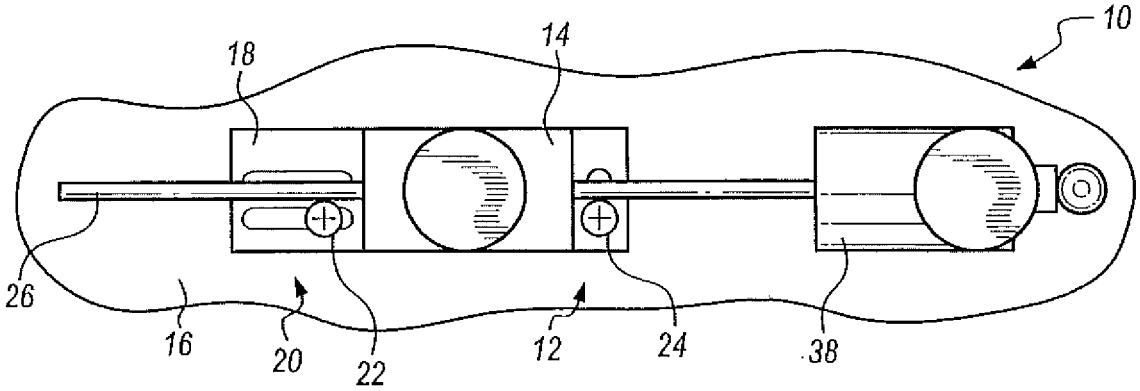
FIG. 1 is a top-plan view of the apparatus of the present application installed on a stringed instrument.
Figure 2:
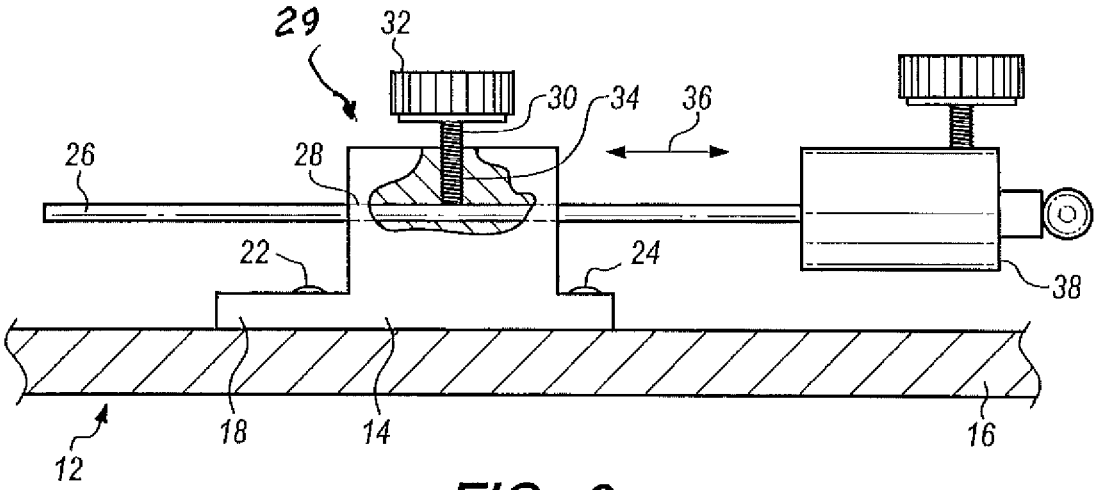
FIG. 2 is a right-side elevational view of the apparatus of the present application depicted in FIG. 1.
Figure 3:
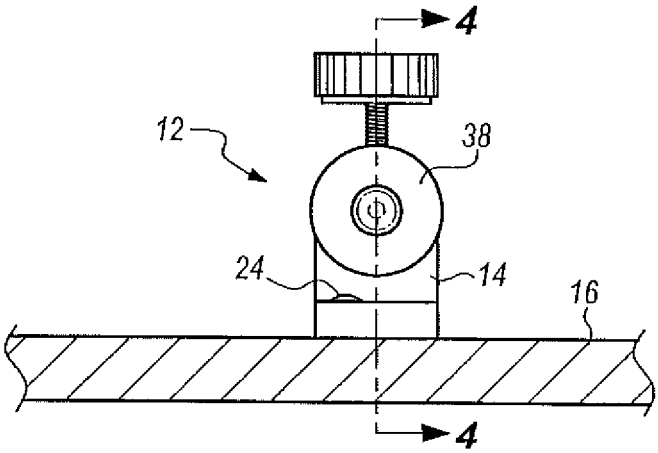
FIG. 3 is a rear elevational view of the apparatus depicted in FIGS. 1 and 2.

The invention as a whole is shown in the drawings by reference character 10. The dead spot eliminator apparatus 10 includes as one of its elements a resonator 12. Resonator 12 includes a base 14 which may be attached to a portion of the stringed instrument 16. For example, such stringed instrument portion 16 may take the back of a peghead of an electric bass. In this regard, base 14 is constructed with a foot 18 that includes a plurality of slots or apertures 20 which are capable of accepting fasteners. As is depicted in FIGS. 1-3, fasteners 22 and 24 are illustrated holding base 14 to stringed instrument portion 16. Resonator 12 also includes an elongated member or rod 26 which slidingly engages base 14, passing through an aperture 28 across base 14. A set screw 30, with a gripping knob 32, threadingly engages a threaded opening 34 in base 14 to allow set screw 30 to contact and fix elongated element 26 relative to base 14. Thus, aperture 28 of base 14 serves as a guide 29 for adjusting the relative position of elongated member 26 relative to base 14. Directional arrow 36 of FIG. 2 indicates the back and forth positioning of elongated element 26 relative to base 14 in this regard. Resonator 12 also includes a weight body 38. Weight body 38 is mounted on elongated member 26. Weight body 38 and the structure of elongated member 26 are detailed on FIGS. 4 and 5.

Figure 4:
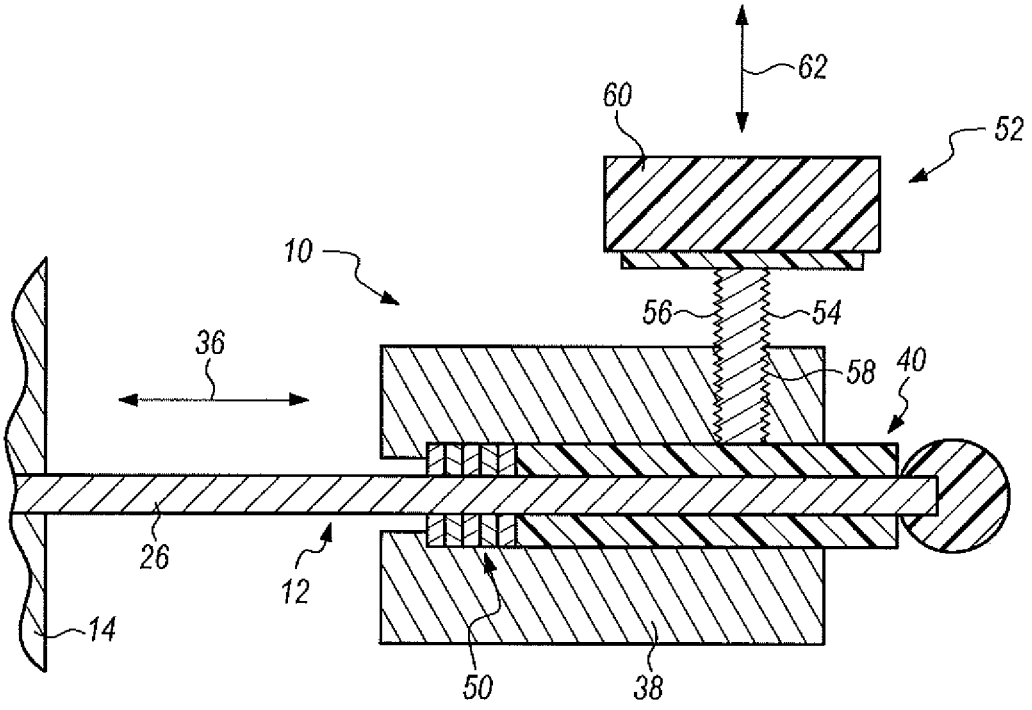
FIG. 4 is a sectional view taken along line 4-4 of FIG. 3, with elimination of the body of the stringed instrument.
Figure 5:
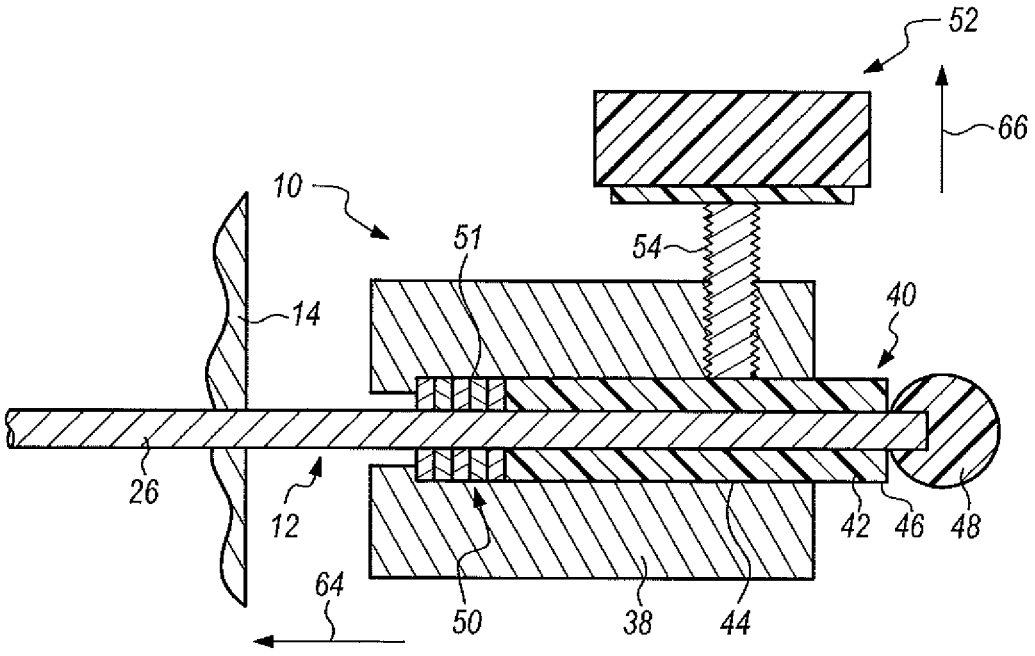
FIG. 5 is a sectional view, similar to that taken along line 4-4 of FIG. 3, in which the distance between the weight body and the base has been shortened.

A sonic damper 40 is also found in the apparatus 10 of the present application. Sonic damper 40 utilizes an elastomeric element 42 which at least partially occupies a recess or tunnel 44, through weight body 38. Elastomeric element 42 circumvents and frictionally contacts elongated member 26 which also extends through recess 44 in weight body 38. As depicted in FIGS. 4 and 5, elastomeric element 42 further includes a portion 46 that extends outside of recess 44. A keeper 48 fastens to elongated member 26 and serves to aid in the confinement of elastomeric element 42 within recess 44 of weight body 38. In addition, a plurality of resilient members 50 circumvent elongated member 26 and also lie within recess 44 and rest against shoulder 57 of weight body 38. In essence, plurality of resilient elements may take the form of rubber O-rings. It has been ascertained that the combination of elastomeric element 42 and plurality of resilient elements 50 provide efficient damping of apparatus 10 by adjusting the frequency response thereof.

A tensioner 52 of elastomeric element 82 includes a shaft 54 having a threaded outer surface 56 that threadingly engages a threaded aperture 58 through weight body 38. The turning of knob 60 exerts a force via shaft 54 on elastomeric element 42. The adjustment of tensioner 52 is indicated by directional arrow 62. In general, the tightening of tensioner 62 against elastomeric element 42 will lessen the damping function of sonic damper 40 and vice versa.

In operation, the user fastens apparatus 10 to a portion 16 of a stringed instrument, such as the back of the peghead of an electric bass. Once in place, the frequency of the resonator is adjusted by the contraction or extension of elongated member 26 relative to base 14 of apparatus 10. Knob 32 is then turned to fix elongated member 26 in place. The movement of elongated member 26 and attached weight body 38 is indicated by directional arrow 36 on FIGS. 2 and 4. In general, the movement of elongated member 26 and connected weight body 38 toward base 14 sets resonator 12 to a higher frequency and vice versa. With reference to FIG. 5, it may be observed that the weight body 38 of resonator 12 has been shifted toward base 14 by sliding elongated member 26, directional arrow 64. In addition, FIG. 5 illustrates the upward movement of shaft 54 of tensioner 52 to relieve tension on elastomeric element 42, creating increased damping of apparatus 10. Directional arrow 66 indicates such adjustment. Consequently, through the adjustment of resonator 12 and sonic damper 40, a dead spot has been eliminated on the stringed instrument associated with portion 16, thus establishing "sustain" on a particular note being played on such stringed instrument.

While in the foregoing, embodiments of the application have been set forth in considerable detail for the purposes of making a complete disclosure of the invention, it may be apparent to those of skill in the art that numerous changes may be made in such details without departing from the spirit and principles of the invention.

What is claimed is:

1. A sonic dead spot elimination apparatus for employment on a stringed instrument, comprising:

a resonator, said resonator comprising a base and an extending elongated member, said resonator further comprising a guide for adjusting the relative position of said elongated member relative to said base;

a weight body, said weight body being mounted on said elongated member apart from said base;

a sonic damper, said sonic damper comprising an elastomeric element, said weight body further including a recess, said elastomeric element at least partially occupying said recess of said weight body and being positioned adjacent said elongated member and said weight body.

2. The apparatus of claim 1 which additionally comprises a tensioner, said tensioner being able to contact said elastomeric element and being able to impose varying forces on said elastomeric member, thereby.

3. The apparatus of claim 2 in which said elastomeric member at least partially occupies said recess in said weight body and is movable relative to said recess in said weight body.

4. The apparatus of claim 3 in which said elastomeric member slidingly engages said weight body, circumvents and connects to said elongated member, and is configured to at least partially extend outside said recess of said weight body.

5. The apparatus of claim 3 which additionally comprises a plurality of resilient elements positioned adjacent said elastomeric member at least partially occupying said recess of said weight body.

6. The apparatus of claim 5 in which said plurality of resilient elements each circumvent said elongated member.

7. The apparatus of claim 1 which additionally comprises a foot, said foot connected to said base and including at least one aperture, said foot being adapted to lie atop a portion of said stringed instrument.

8. The apparatus of claim 7 which additionally comprises a tensioner, said tensioner being able to contact said elastomeric element and being able to impose varying forces on said elastomeric member.

9. The apparatus of claim 8 in which said elastomeric member at least partially occupies said recess in said weight body and is movable relative to said recess in said weight body.

10. The apparatus of claim 9 in which said elastomeric member slidingly engages said weight body, circumvents and connects to said elongated member, and is configured to at least partially extend outside said recess of said weight body.

11. The apparatus of claim 10 which additionally comprises a plurality of resilient elements positioned adjacent said elastomeric member at least partially occupying said recess of said weight body.

12. The apparatus of claim 11 in which said plurality of resilient elements each circumvent said elongated member.

* * * * *